US009234289B2

(12) United States Patent
Hsu

(10) Patent No.: US 9,234,289 B2
(45) Date of Patent: Jan. 12, 2016

(54) METHOD FOR MANUFACTURING A MOLDING CORE

(71) Applicant: HON HAI PRECISION INDUSTRY CO., LTD., New Taipei (TW)

(72) Inventor: Chia-Ling Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 334 days.

(21) Appl. No.: 13/952,868

(22) Filed: Jul. 29, 2013

(65) Prior Publication Data

US 2014/0202869 A1 Jul. 24, 2014

(30) Foreign Application Priority Data

Jan. 21, 2013 (TW) ..... 102102150 A

(51) Int. Cl.
*C25D 1/10* (2006.01)
*C25D 1/04* (2006.01)
*C25D 1/20* (2006.01)

(52) U.S. Cl.
CPC .. *C25D 1/10* (2013.01); *C25D 1/04* (2013.01); *C25D 1/20* (2013.01)

(58) Field of Classification Search
CPC ..... C25D 1/10; C25D 1/02; C25D 1/04; C25D 1/20
USPC ..... 205/67–79; 73/324–341
See application file for complete search history.

(56) References Cited

U.S. PATENT DOCUMENTS

| | | | | | |
|---|---|---|---|---|---|
| 2,749,294 | A * | 6/1956 | Winstead | C25D 1/10 | 205/70 |
| 4,391,879 | A * | 7/1983 | Fabian | B41N 1/006 | 101/153 |
| 4,556,610 | A * | 12/1985 | van Heuvelen | B41C 1/182 | 101/153 |
| 5,247,884 | A * | 9/1993 | Rid | B41N 1/20 | 101/375 |
| 6,401,614 | B1 * | 6/2002 | Venturati | B41N 1/20 | 101/153 |
| 2004/0120136 | A1 * | 6/2004 | Olczak | G05B 19/182 | 362/601 |
| 2007/0125655 | A1 * | 6/2007 | Buckley | C25D 1/10 | 205/70 |

* cited by examiner

*Primary Examiner* — Luan Van
*Assistant Examiner* — Louis Rufo
(74) *Attorney, Agent, or Firm* — Novak Druce Connolly Bove + Quigg LLP

(57) ABSTRACT

A method for manufacturing a molding core includes: providing a cylindrical roller having a circumference surface coated with a first film layer; coating a second film layer on the first film layer; coating a preprocessed molding film on the second film layer; engraving a number of molding patterns on the preprocessed molding film to obtain a molding film; separating the molding film from the roller and spreading out the molding film to be a flat plate; and manufacturing the molding core using the molding film by electroforming method.

7 Claims, 2 Drawing Sheets

METHOD FOR MANUFACTURING A MOLDING CORE

BACKGROUND

1. Technical Field

The present disclosure relates to a method for manufacturing a molding core.

2. Description of Related Art

Optical films include a number of micro structures, therefore, molding cores of optical films need to include a number of molding patterns mated with the micro structures. Currently, the molding patterns are formed by a laser knife. However, a lot of metal scraps are formed around the molding patterns when the molding core is machined by the laser knife and the metal scraps are difficult to be removed, and thus the quality of the molding core is influenced.

Therefore, it is desirable to provide a method for manufacturing a molding core that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
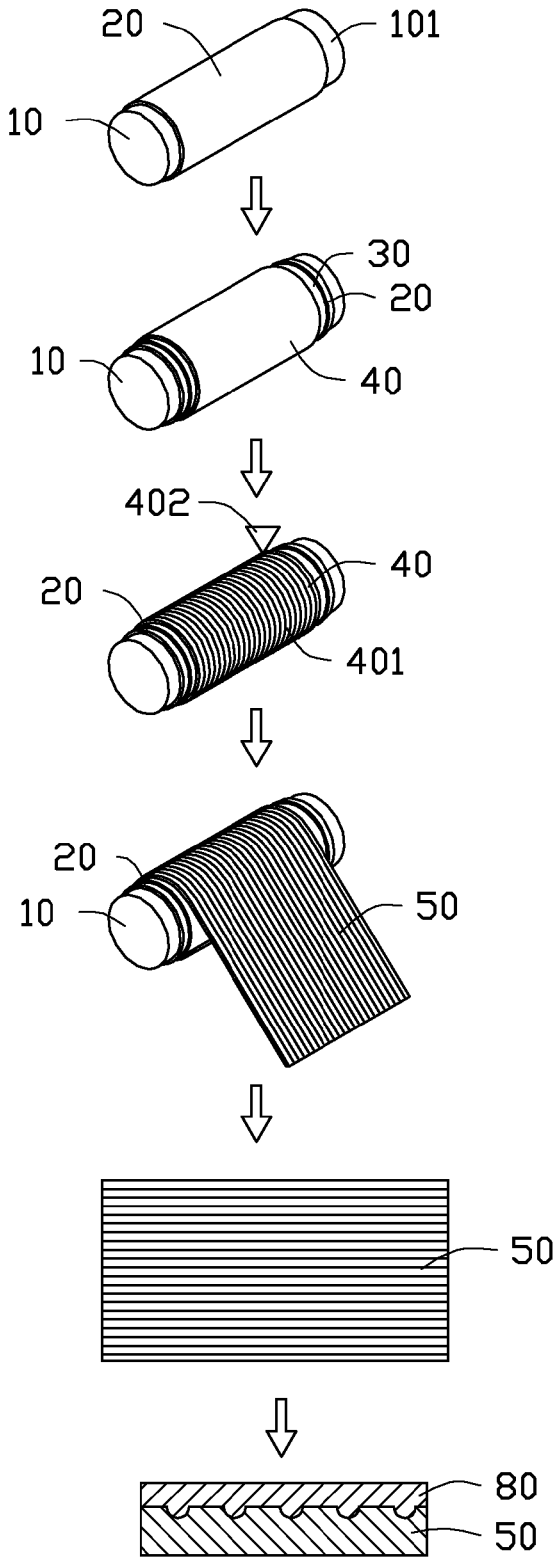
FIG. 1 is a schematic view of a method for manufacturing a molding core, according to an exemplary embodiment.

FIG. 1 illustrates a method for manufacturing a molding core in accordance to an exemplary embodiment. The method includes the following steps.

In step S1, a cylindrical roller 10 is provided, and a circumferential surface 101 of the roller 10 is coated with a first film layer 20. In this embodiment, the first film layer 20 is made of copper.

In step S2, a second film layer 30 is directly coated on the first film layer 20. In this embodiment, the second film layer 30 is made of silver nitrate.

In step S3, a preprocessed molding film 40 is coated on the second film layer 30. In this embodiment, the preprocessed molding film 40 is made of hard copper, and the thickness of the preprocessed molding film 40 is about 150 micrometers (μm).

In step S4, a number of molding patterns 401 are formed on the preprocessed molding film 40 using an electronic engraving machine 402, and thus the preprocessed molding film 40 becomes a molding film 50, and the molding film 50 is obtained.

In step S5, the molding film 50 is cut along a direction substantially parallel to an axial direction of the roller 10, and then the molding film 50 is separated from the roller 10, and is flatly spread out to be a flat plate.

In step S6, the molding film 50 is used to manufacture a molding core 80 by electroforming technology. In this embodiment, the molding core 80 is made of nickel.

Figure 2:
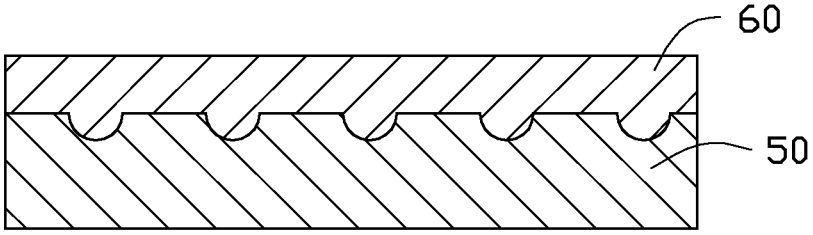
FIG. 2 is a schematic view showing a step of forming a protective film on a molding film used in the method of FIG. 1.

Also referring to FIG. 2, the step S4 includes a sub-step: a protective film 60 (such as nickel film) is formed on the molding film 50 using electroforming technology, and thus to prevent the molding film 50 from being damaged to improve the quality of the molding cores 80. The step S5 further includes a sub-step: the molding film 50 with the protective film 60 is separated from the roller 10. The step S6 further includes a sub-step: the protective film 60 is separated from the molding film 50 firstly, then the molding core 80 is manufactured using the molding film 50. In this embodiment, the thickness of the protective film 60 is about 1 μm. In other embodiments, the protective film 60 also can be omitted.

By employing the above described method, the molding film 50 is manufactured by electronic engraving technology, and the molding core is manufactured using the molding film 50 by electroforming technology, therefore, no metal scrap is produced around the molding patterns 401, and thus the quality of the molding core can be improved.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A method for manufacturing a molding core, comprising:

providing a cylindrical roller having a circumference surface coated with a first film layer;

coating a second film layer on the first film layer;

coating a preprocessed molding film on the second film layer;

engraving a plurality of molding patterns on the preprocessed molding film using an electronic engraving machine to obtain a molding film;

separating the molding film from the roller and spreading out the molding film to be a flat plate; and electroforming the flat plate to form the molding core, wherein the first film layer is made of copper, the preprocessed molding film is made of hard copper, and the second film layer is made of silver nitrate.

2. The method of claim 1, wherein a thickness of the preprocessed molding film is about 150 micrometers.

3. The method of claim 1, wherein the molding film is cut along a direction substantially parallel to an axial direction of the roller, so as to separate the molding film from the roller.

4. The method of claim 1, comprising forming a protective film on the molding film to protect the molding patterns after the step of engraving a plurality of molding patterns on the preprocessed molding film to obtain a molding film.

5. The method of claim 4, wherein the step of separating the molding film from the roller and spreading out the molding film to be a flat plate comprises separating the molding film with the protective film protective film from the roller.

6. The method of claim 5, comprising separating the protective film from the molding film before the step of manufacturing the molding core using the molding film by electro forming method.

7. The method of claim 4, wherein the protective film is made of nickel.

* * * * *